US009024544B2

(12) United States Patent
Nagao et al.

(10) Patent No.: US 9,024,544 B2
(45) Date of Patent: May 5, 2015

(54) FIELD EMISSION DEVICE

(75) Inventors: Masayoshi Nagao, Tsukuba (JP); Tomoya Yoshida, Tsukuba (JP); Yoichiro Neo, Hamamatsu (JP)

(73) Assignee: National University Corporation Sizuoka University, Shizuoka (JP)

( * ) Notice: Subject to any disclaimer, the term of this patent is extended or adjusted under 35 U.S.C. 154(b) by 613 days.

(21) Appl. No.: 13/509,537

(22) PCT Filed: Nov. 10, 2010

(86) PCT No.: PCT/JP2010/070416

§ 371 (c)(1),
(2), (4) Date: May 11, 2012

(87) PCT Pub. No.: WO2011/059103

PCT Pub. Date: May 19, 2011

(65) Prior Publication Data

US 2012/0229051 A1 Sep. 13, 2012

(30) Foreign Application Priority Data

Nov. 13, 2009 (JP) ..... 2009-259464

(51) Int. Cl.
*H01J 3/02* (2006.01)
*H01J 31/12* (2006.01)

(52) U.S. Cl.
CPC ..... *H01J 3/022* (2013.01); *H01J 31/127* (2013.01); *H01J 2203/0208* (2013.01); *H01J 2203/0228* (2013.01); *H01J 2329/4604* (2013.01); *H01J 2329/4626* (2013.01)

(58) Field of Classification Search
CPC . H01J 3/022; H01J 31/127; H01J 2203/0208; H01J 2203/0228; H01J 2329/4604; H01J 2329/4626
See application file for complete search history.

(56) References Cited

U.S. PATENT DOCUMENTS 5,191,217 A * 3/1993 Kane et al. ..... 250/423 F
5,483,118 A * 1/1996 Nakamoto et al. ..... 313/309

(Continued)

FOREIGN PATENT DOCUMENTS

JP 10-12166 A 1/1988
JP 06-275189 A 9/1994

(Continued)

OTHER PUBLICATIONS

Yoichiro Neo, et al., "Focusing Characteristics of Double-Gated Field-Emitter Arrays with a Lower Height of the Focusing Electrode," Applied Physics Express 1, May 2008, pp. 1-3, No. 053001.

(Continued)

*Primary Examiner* — Thomas J Hiltunen
(74) *Attorney, Agent, or Firm* — Sughrue Mion, PLLC

(57) ABSTRACT

In a field emission device, the fundamental cause of spherical aberration in an emitted electron beam trajectory is eliminated or mitigated. An aberration suppressor electrode 31 is provided at a lower vertical position than an extraction gate electrode 13 so its opening inner peripheral edge 31*e* faces a position near an emitter tip 11*tp*. The vertical position of the opening inner peripheral edge 31*e* of the aberration suppressor electrode 31 is made lower than the vertical position of the emitter tip 11*tp*. An aberration suppressing voltage Vsp is applied to the aberration suppressor electrode 31 that is a lower voltage than the potential of the emitter 11 and controls equipotential lines near the emitter tip 11*tp* to make them parallel.

2 Claims, 6 Drawing Sheets

(56) References Cited

U.S. PATENT DOCUMENTS

| | | | | | |
|---|---|---|---|---|---|
| 5,576,594 | A | * | 11/1996 | Toyoda et al. | 313/309 |
| 5,696,028 | A | * | 12/1997 | Rolfson et al. | 438/20 |
| 5,710,478 | A | * | 1/1998 | Kanemaru et al. | 313/336 |
| 5,757,138 | A | * | 5/1998 | Tsai | 315/169.3 |
| 5,850,120 | A | * | 12/1998 | Okamoto | 313/336 |
| 5,982,081 | A | * | 11/1999 | Sin et al. | 313/309 |
| 6,190,223 | B1 | * | 2/2001 | Tjaden et al. | 445/24 |
| 6,197,607 | B1 | * | 3/2001 | Derraa | 438/20 |
| 6,417,605 | B1 | * | 7/2002 | Hofmann et al. | 313/309 |
| 6,469,436 | B1 | * | 10/2002 | Williams et al. | 313/496 |

FOREIGN PATENT DOCUMENTS

| | | | |
|---|---|---|---|
| JP | 07-192682 | A | 7/1995 |
| JP | 08-007772 | A | 1/1996 |
| JP | 10-149778 | A | 6/1998 |
| JP | 2835434 | B2 | 12/1998 |
| JP | 2000-268706 | A | 9/2000 |
| JP | 2002-352695 | A | 12/2002 |
| JP | 3547531 | B2 | 7/2004 |
| JP | 2010-055907 | A | 3/2010 |

OTHER PUBLICATIONS

Yoshikazu Yamaoka, et al., "Fabrication of Silicon Field Emitter Arrays Integrated with Beam Focusing Lens," Jpn. J. Appl. Phys., Dec. 1996, pp. 6626-6628, vol. 35, Part 1, No. 12B.

Extended European Search Report for Application No. 10830059.1-1556 / 2500926 PCT/JP2010070416 dated Mar. 12, 2013.

* cited by examiner

Fig. 4 (A)
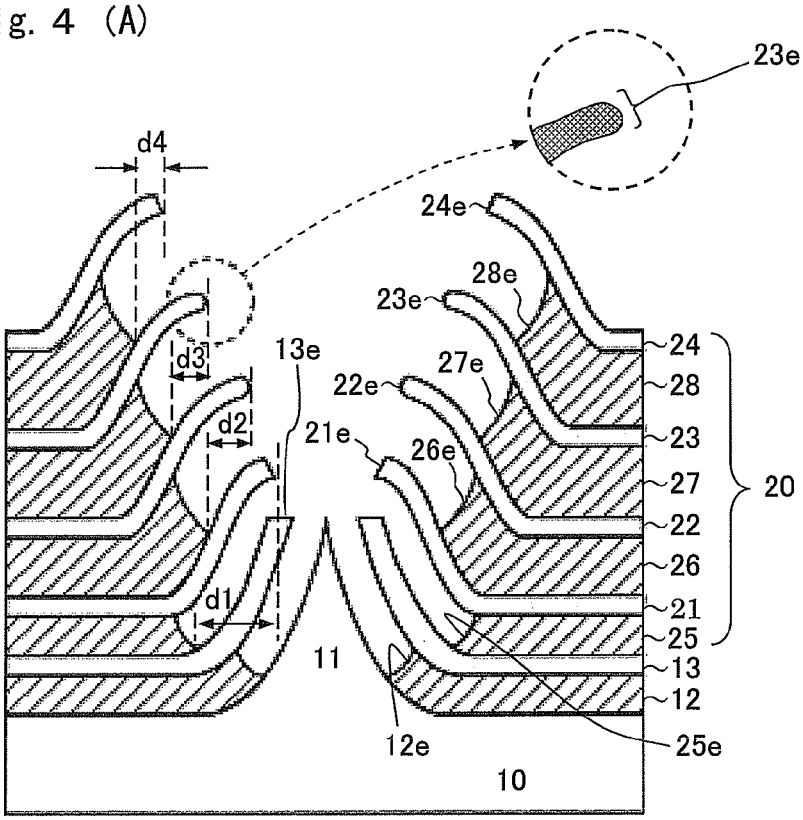
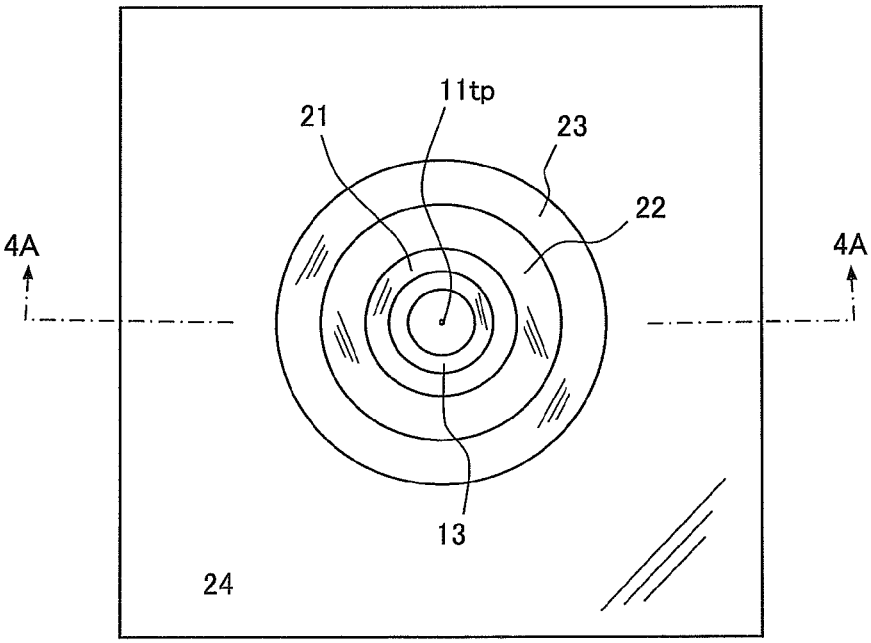
Fig. 4 (B)

FIELD EMISSION DEVICE

CROSS REFERENCE TO RELATED APPLICATION

This application is a National Stage of International Application No. PCT/JP2010/070416 filed Nov. 10, 2010, the contents of which are incorporated herein by reference in their entirety.

TECHNICAL FIELD

The present invention relates to a field emission device (also called a "cold electron emitter") whose emitter formed on a substrate is applied with a high field at its sharp tip to discharge electrons from the emitter tip, particularly to an improvement for suppressing probable spherical aberration in the emitted electron trajectory when the emitted electrons are output toward an anode under focusing.

BACKGROUND ART

The field emission device (FED) was initially studied and developed for use as an electron emission source suitable mainly for the flat panel display (FPD) type image display device to replace the classical thermionic emission type cathode ray tube (CRT). In recent times, a need has started to be felt for a field emission device with the capability to adequately focus the electron beam emitted from the emitter tip so as to be suitable also as an electron beam lithography electron source or a FPD requiring ultrahigh definition.

As a field emission device studied in response to this, there is known a field emission device with built-in focusing electrode, generally known by the abbreviated name "double-gate type," which, as taught by Document 1 indicated below, is not only provided with an extraction gate electrode around the emitter tip but is additionally equipped with a focusing electrode (lens electrode) for focusing the electron beam. In the case of this type of field emission device with built-in focusing electrode, referred to as an "FEA with built-in lens," the extraction gate electrode and the focusing electrode are both configured to have openings (desirably circular openings as perfectly round as possible) that expose the tip of the emitter formed on the substrate to the space above. Therefore, in the sense that these electrodes surround the emitter, they are from the shape aspect called ring electrodes.

Document 1: "Fabrication of Silicon Field emitter arrays Integrated with beam focusing lens", Yoshikazu Yamaoka et al., Jpn. J. Appl. Phys., Vol. 35, Part 1, No. 12B, (1996) pp. 6626-6628.

With regard to the focusing electrode, this Document 1 sets out three configurations, (a)-(c), in its positional relationship with the extraction gate electrode.

(a) Structure in which the focusing electrode is provided above the extraction gate electrode.

(b) Structure in which it is provided in the same plane to surround the extraction gate electrode.

(c) Structure in which it is stacked on top of the extraction gate electrode but the rim of the extraction gate electrode opening rises in the vertical direction like a conide (Fujiyama-shaped/conical) volcano crater to enter the opening of the focusing electrode in an upwardly mounded shape, whereby the height of the rim of the focusing electrode opening becomes substantially the same as the height of the rim of the extraction gate electrode opening.

In the case of a field emission device with built-in focusing electrode which has at least a focusing electrode in addition to an extraction gate electrode, when the emitter potential is made 0 V, for example, a certain positive voltage Vex is of course applied to the extraction gate electrode in order to extract electrons. A voltage Vf at least lower than Vex (Vf<Vex) is applied to the focusing electrode in order to focus the emitted electron beam. Although the focusing effect is naturally stronger as Vf is lower, the amount of current that can be extracted from the emitter decreases markedly if Vf is lowered to near 0V. This is because the electric field concentration at the emitter tip is relaxed by the voltage Vf lower than Vex, with the result that the field strength applied to the emitter tip weakens.

In order to overcome this problem, a scheme has been devised whereby, as seen in Document 2 indicated below, the position of the rim of the focusing electrode opening is set lower than the position of the rim of the extraction gate electrode opening so as to keep the low potential distribution produced by the focusing electrode from reaching the emitter tip, thereby obtaining an emitted electron beam focusing effect while maintaining the field strength applied to the emitter tip.

Document 2: "Focusing Characteristics of Double-Gated Field-Emitter Arrays with a Lower Height of the Focusing Electrode", Yoichiro Neo et al., Appl. Phys. Exp. 1 (2008), 053001-3.

However, even with such a structure, when it is attempted to achieve a stronger focusing effect, the potential barrier of low potential produced by the focusing electrode is still formed above the emitter tip, so that part of the emitted electron beam undesirably returns to the gate without being able to go beyond the potential barrier, thus posing another problem of the extractable amount of current again decreasing.

Therefore, it was attempted to avoid a potential barrier from being formed on a line perpendicular to the emitter tip which is the electron emission point by providing still another focusing electrode stage and applying a positive voltage thereto. In FIG. 2 of Document 3 indicated below and FIG. 9 of Document 4 indicated below, structures having two focusing electrodes are shown.

Document 3: Unexamined Japanese Patent Publication H7-192682

Document 4: Unexamined Japanese Patent Publication H6-275189

However, electric field calculation and electron trajectory computer simulation carried out earlier by the present inventors found that whilst a device structure having two focusing electrodes as focusing lenses does in fact enable formation of a focused electron beam, the field concentration at the emitter tip is lost and the amount of discharged current decreases. In other words, a potential distribution to the focusing electrodes that enables electron beam focusing without loss of the electric field on the emitter tip could not be found within the range of voltages that can be applied to an actual device.

So the present inventors also considered a field emission device with built-in focusing electrode structured to include another focusing electrode so as to have a laminated structure with a total of three focusing electrodes. The reason was that they thought that by this, even when applying a potential low enough to satisfy the focusing effect at the intermediate second focusing electrode, it might be possible for the lowermost first focusing electrode to prevent the so-caused relaxation of the electric field concentration of the emitter tip and be further possible for the uppermost third focusing electrode to prevent a potential barrier from being formed on a line perpendicular to the electron emission point.

From verification results, such a structure was in fact determined to obtain satisfactory characteristics as the device electrical characteristics. However, a problem was next encountered from the aspect of fabrication method. Specifically, it was found that when such a three-fold focusing electrode structure is adopted, an efficient electron beam focusing effect cannot be obtained unless the intermediate second focusing electrode is given a considerably large film thickness of, say, 1 μm or greater as compared with the approximately 200 nm that suffices for the other electrodes. But when it is attempted to form on the same substrate such a structure wherein only the second focusing electrode is thick, such a structure cannot be favorably fabricated no matter which of the various fabrication methods so far reported is applied.

In order to resolve this problem, some of the inventors proposed in Document 5 indicated below, which was filed as Japanese Patent Application 2008-218897, a rational device production method and a field emission device, such as shown in FIG. 4, of a structure obtained by stacking at least four stages of focusing electrodes of substantially the same order of thickness. Including the extraction gate electrode of the lowermost stage, the stacked electrode structure came to have five stages in total.

Document 5: Unexamined Japanese Patent Publication 2010-55907

FIG. 4(B) is a plan view of an example of such a field emission device, and (A) of the same figure is a sectional end view along line 4A-4A of the figure. An emitter 11 constituting a sharply pointed electron emission terminal is formed on a substrate 10 by a tip 11*tp*, and in order to expose at least the tip 11*tp* of this emitter 11, an insulating film 12 is provided on the substrate 10, and on this is formed an extraction gate 13 which by application of a suitable voltage (bias voltage) promotes electron emission from the emitter tip 11*tp*.

A stacked focusing electrode structure 20 constituting a focusing lens with respect to the emitted electron trajectory is built above the extraction gate electrode 13. When the unit stacked stage is defined as one insulating film layer and one focusing electrode layer formed thereon, the stacked focusing electrode structure 20 is configured by stacking at least four or more of these unit stacked stages in the direction perpendicular to the substrate 10, and in the illustrated case consists of four stages. Where the lowermost stage, i.e., the focusing electrode 21 located at the lowest position in the vertical direction, is called the first focusing electrode, a second focusing electrode 22, third focusing electrode 23 and fourth focusing electrode 24 are stacked upward in order via first~fourth insulating films 25~28, respectively.

As shown in FIG. 4(B), the extraction gate electrode 13 and the first to fourth focusing electrodes 21~24 all have openings as seen from above in plan view, and these openings are generally most desirably circular openings. Therefore, as seen in the sectional end view of FIG. 4(A), the insulating films 12, 25~28, and the electrodes 13, 21~24, are all provided so as to surround the emitter 11 while being spaced apart from the emitter 11 in the radial direction.

In other words, as regards the insulating films 12, 25~28, the inner peripheral edges 12*e*, 25*e*~28*e* of their openings, and as regards the electrodes 13, 21~24, the inner peripheral edges 13*e*, 21*e*~24*e* of their openings are the respective portions of closest to the emitter 11 as viewed in the radial direction. Further, the sectional configuration resembles the shape near the crater of a conide (Fujiyama-shaped/conical) volcano, and the vicinity of the openings 12*e*, 25*e* to 28*e*: 13*e*, 21*e*~24*e* are all shaped to be upwardly mounded above the plain below.

In comparison with not only the conventional device of two or fewer focusing electrodes but also with the device having three focusing electrodes that is impractical from the aspect of fabrication method, the field emission device with built-in focusing electrode in which the four focusing electrodes 21~24 are stacked in this manner can satisfy the required condition of a fundamental structure enabling thoroughly practical fabrication, while greatly improving freedom of how potential is imparted, giving rise to freedom and accuracy in electric field distribution control, and basically overcoming the risk of electron current decline, electron reversal, and the like.

In such a structure, Document 5 teaches that for obtaining optimum electric field concentration, the vertical positions of the tip 11*tp* of the emitter 11 and the inner peripheral edge 13*e* of the extraction gate electrode 13 are desirably given the same height or the emitter tip 11*tp* is made about 0.1 μm higher, and/or, as shown by dimensions d1~d4, the inner peripheral edges 25*e*~28*e* of the insulating films 25~28 are desirably set back somewhat more in the radially outward direction than the inner peripheral edges 21*e*~24*e* of the electrodes 21~24 respectively on top of themselves.

As collision of the emitted electrons with the insulating films 25~28 degrades the dielectric strength voltage of these portions, giving rise to a risk of leakage current occurrence and lowering reliability, the latter is for preventing this, and since collision of emitted electrons with residual gas molecules before arriving at an anode electrode not shown in the drawings ionizes the gas molecules, so that generated positive ions are accelerated toward the emitter 11 in the opposite direction from the electrons to eventually collide with some part of the structure built on the substrate 10, is for ensuring that such collision does not arise because should the collision occur at the insulating film, it will again lead to degradation of the dielectric strength voltage. As is well known, when the voltage applied to the anode electrode is on the order of several kV, it is far higher than the voltages applied to the extraction gate electrode 13 and the focusing electrodes 21~24, so that the positive ion trajectory becomes substantially perpendicular to the substrate 10 irrespective of the voltage applied to the extraction gate electrode 13 and the focusing electrodes 21~24. Therefore, in order to prevent the positive ions from colliding with the insulating films 25~28, it is necessary to set the insulating films 25~28 to positions where the insulating film inner peripheral edges 25*e*~28*e* are not visible when looking at the device from vertically above. Therefore, in the case of a configuration wherein, as illustrated, the electrode opening diameter decreases with lower electrode position, it is, in line with this, better to define the setback distance larger (make the setback distance longer) as the insulating film is lower and nearer to the emitter 11, i.e., is better to define d1>d2>d3>d4.

Further, since it is troublesome if, for example, electric field concentration at the focusing electrode 22 and third focusing electrode 23 becomes so great as to cause field emission therefrom, to avoid this, electron emission is impeded by increasing the work function of at least the electrodes where field emission is probable, or as indicated taking the third focusing electrode 23 as representative and enlarging the peripheral edge 23*e* at the portion of FIG. 4(A) enclosed by a phantom line, it is considered preferable to avoid a sharp angle at the joining edges between the electrode surfaces and the face of the peripheral edge 23*e* orthogonal thereto by processing the surface of the opening peripheral edge to a smooth shape having no angle, e.g., to a sectionally semicircular shape.

As clarified later herein, the present invention teaches another improved configuration from a viewpoint different from Document 5 explained above, but it is noted beforehand that when the present invention is applied to a device of sectional structure similar to the field emission device shown FIG. 4, the various considerations set out in the foregoing can be applied without modification also in the field emission device to which the present invention is applied.

At any rate, it goes without doubt that the provision of the field emission device shown in FIG. 4 overcomes or at least mitigates the various drawbacks and disadvantages of earlier field emission devices. The electron beam emitted from the emitter can be thoroughly focused without reducing the extractable amount of electron current, freedom of how potential is imparted to the electrodes is greatly improved, and freedom and accuracy of electric field distribution control is realized. In other words, it can be said that there was provided a fundamental structure for applying desirable bias voltage for ensuring electron current and enabling electron beam focusing.

However, even the field emission device shown in FIG. 4, which is far superior to earlier ones, was found as a result of studies carried out by the present inventors to still have a problem that needs to be resolved. This can be explained with reference to the simulation results of FIG. 5. In this figure, symbols the same as those in FIG. 4 indicate the same constituent elements, but as indicated by the portion Ee enclosed by a phantom line circle, the trajectory of those among the electrodes emitted from the tip 11*tp* of the emitter 11 that pass near the outer peripheral edge of the focusing lens constituted by the focusing electrodes 21~24 is markedly curved compared with the trajectory of the electrons passing through the lens center region and thus becomes an electron trajectory Edsp that is a source of aberration giving rise to spherical aberration.

As aberration of the electron beam is of course undesirable, it needs to be prevented, and it is conceivable to interpose an opening structural member, classically called an aperture, to block or bounce back the electron trajectory Edsp that is the cause of aberration. Even in a field emission device of a sectional structure such as shown in FIG. 4(A), it is not impossible to configure an aperture by, for example, minimally designing the opening diameter of the focusing electrode 21 immediately above the extraction gate 13 or the other focusing electrodes 22~24. However, when electrodes collide with the electrode constituting the aperture, the impact causes gas to discharge from the electrode. When the discharged gas causes electrical discharge to occur between the electrodes, particularly with the emitter, it leads to immediate device destruction. This is especially true in the case of an intricate field emission device fabricated using fine processing technology down to the nano-order. Since this is something that must absolutely be avoided, the upshot becomes that it is not practical to use one of the stacked electrodes also as an aperture.

In this regard, what can be equally said not only about the field emission device shown in FIG. 4 but also about the field emission devices known heretofore is that little observation and consideration have been made with respect to the form of equipotential lines (two-dimensionally equipotential planes) in the vicinity of the tip 11*tp* of the emitter 11, i.e., with respect to potential distribution.

Specifically, in this type of field emission device, equipotential lines are formed in shapes following the outer surface contour of the emitter 11, as shown in FIG. 6, and the electrons emitted from the emitter tip 11*tp* are accelerated perpendicular to these equipotential lines. This situation does not change no matter how the potential of the extraction gate electrode 13 is varied. It can be seen that in this case, when electrons are emitted right on the center axis, they are accelerated straight along the center axis to make the desirable electron trajectory Ec, but when they deviate even slightly from the center axis, they are accelerated in a direction departing from the center axis. Thus, the electrons accelerated in an outwardly inclined direction from the center axis come to be emitted along the electron trajectory Edsp causing spherical aberration. Note that while FIG. 6 is a simulation diagram where the emitter potential was set at 0 V and the potential of the extraction gate electrode 13 at 50 V, even under other potential conditions the nonparallel equipotential lines ordinarily remain as generated in the vicinity of the emitter tip 11*tp*, and these become the primary cause of spherical aberration.

DISCLOSURE OF THE INVENTION

Focusing on this point, the present invention endeavors, by means of a new field emission device structure, to enable elimination or mitigation of the fundamental cause of spherical aberration in an emitted electron beam trajectory.

In order to achieve this objective, a field emission device of the structure set out below is proposed in the present invention.

A field emission device comprises an emitter on a substrate constituting an electron emission terminal having a sharp tip, and an extraction gate electrode having an opening that exposes the emitter tip and causes emission of electrons from the emitter by applying an extraction voltage. This field emission device further comprises an aberration suppressor electrode having an opening that exposes the emitter tip and whose opening inner peripheral edge is provided at a position nearer the emitter tip than the opening inner peripheral edge of the extraction gate electrode; wherein while the inner peripheral edge of the opening of the extraction gate electrode being higher than a vertical position of the emitter tip, a vertical position of the aberration suppressor electrode is lower than a vertical position of the emitter tip; an aberration suppressing voltage application circuit is connected to the aberration suppressor electrode and an aberration suppressing voltage application circuit is connected thereto; and the aberration suppressing voltage application circuit applies to the aberration suppressor electrode an aberration suppressing voltage in a voltage range lower than the emitter potential to control equipotential lines in the vicinity of the emitter tip to be parallel.

In the foregoing configuration, when the diameter of the opening of the aberration suppressor electrode that exposes the emitter tip is made submicron order or less in line with the predominantly nano-order-to-submicron-order fabrication environment that has recently become the norm in this type of field emission device, the vertical difference between the vertical position of the aberration suppressor electrode and the vertical position of the emitter tip is desirably 50 nm or greater to 100 nm or less. With respect to an aberration suppressor electrode in this dimension range, it is possible, as set out later, to apply an aberration suppressing voltage of an optimally effective suitable value within a range unlikely to cause other problems.

EFFECT OF THE INVENTION

By the present invention, it is possible in accordance with the technical concept of newly adding an aberration suppressor electrode to control the potential distribution in the vicinity of the emitter tip to control the equipotential lines to a direction making them as parallel as possible, so that spherical aberration can be effectively suppressed at the fundamental level. Therefore, the electron beam focusing capability as a field emission device can also be improved without problems to enhance the performance and increase the reliability of the device, thereby enabling expanded application and utilization.

BRIEF DESCRIPTION OF THE DRAWINGS

FIG. 4(A) is a schematic sectional view of a conventionally provided field emission device.

FIG. 4(B) is a schematic plan view of the device shown in FIG. 4(A).

BEST MODE FOR CARRYING OUT THE INVENTION

Figure 1:
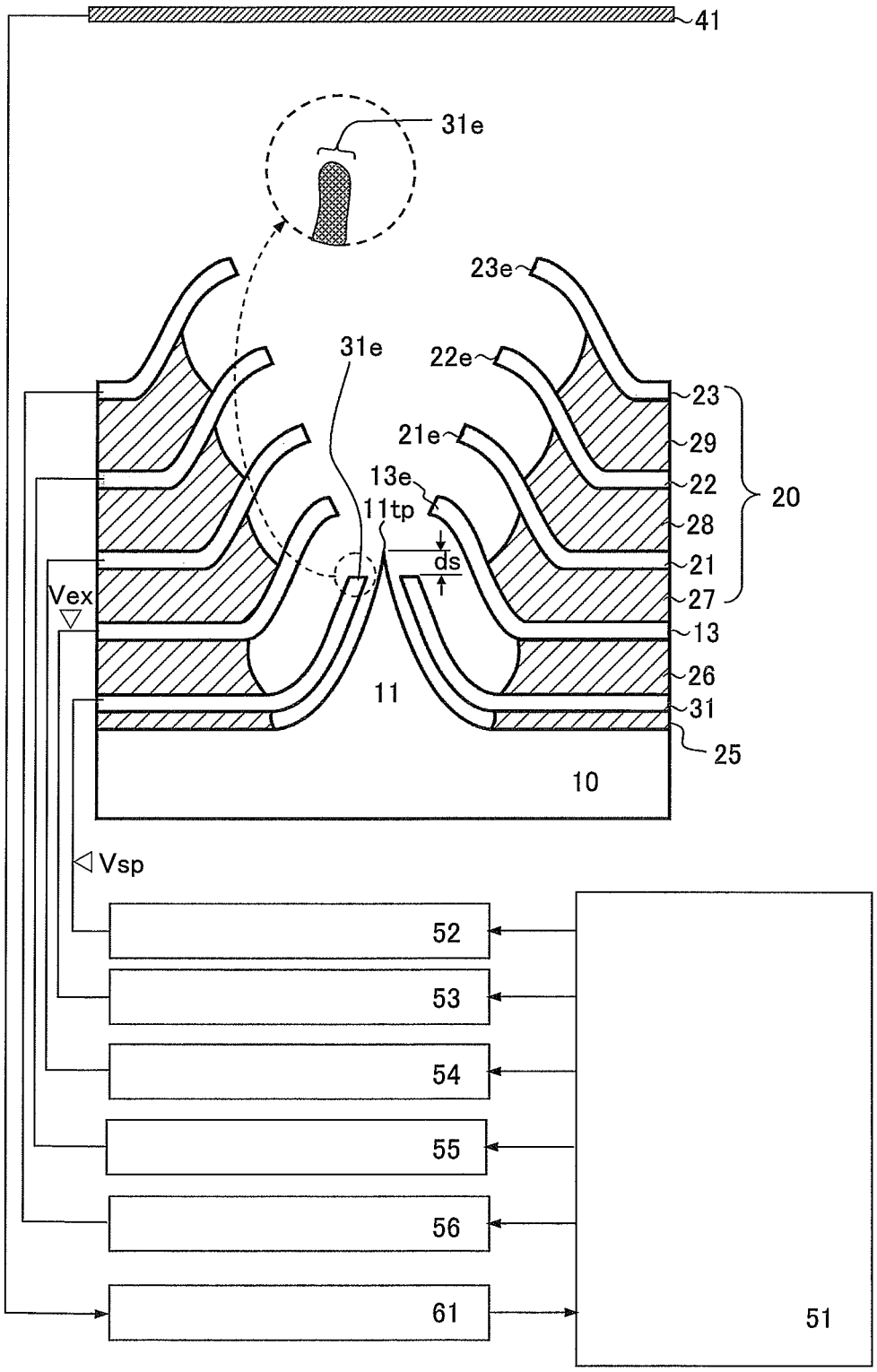
FIG. 1 is schematic block diagram of a field emission device of a preferred embodiment of the present invention.

In the following, an explanation is given with reference to FIG. 1 onward regarding a field emission device that is a preferred embodiment of the present invention. Viewed in sectional structure, the field emission device of this embodiment closely resembles the already-explained field emission device with built-in focusing electrode illustrated in FIG. 4, and is the same in that it has a five-stage electrode configuration when only the electrodes are focused on.

However, where it greatly differs is in that the electrode nearest the tip 11*tp* of the emitter 11 formed on the substrate 10 is not an extraction gate as heretofore but an aberration suppressor electrode 31 newly added by the present invention. Further, as already mentioned, the extraction gate electrode 13 has applied thereto a voltage (generally a positive potential) Vex generally higher than the emitter potential (generally the substrate potential and usually 0V), but as explained in detail later, the aberration suppressor electrode 31 provided by the present invention below the extraction gate electrode 13 has applied thereto a voltage (generally a negative potential) Vsp lower than the emitter potential.

To structurally explain the field emission device of FIG. 1, the substrate 10 formed with the emitter 11 is provided thereon with the insulating film 25 that exposes at least the tip 11*tp* of the emitter 11, and on this is formed the aberration suppressor electrode 31 added by the present invention, and the opening inner peripheral edge 31*e* of this is positioned nearest to the emitter tip 11*tp* among the various electrodes set out below. Above this, and sandwiching the insulating film 26, is formed the extraction gate electrode 13 for promoting electron discharge from the emitter tip 11*tp* upon application of a suitable voltage (bias voltage), and above this extraction gate 13 is further configured the stacked focusing electrode structure 20.

As the present invention is an improvement from a different viewpoint than the development process of the aforementioned field emission device shown in FIG. 4, it suffices for the stacked focusing electrode structure 20 to include at least one or more focusing electrodes, but none will do in an extreme case, although for the reason set out earlier it desirably has a multiple-layered stacked structure. In the illustrated case, it consists of three focusing electrodes 21, 22 and 23 successively stacked vertically to sandwich the insulating films 27, 28 and 29 between the respective stages. As in the similar plan view of FIG. 4(B), all of the electrodes have openings viewed planarly from above, but, particularly, these openings are most desirably circular openings in a mutually concentric relationship. The insulating films 25~29 under the respective electrodes are also similar, and the tip (electron emission terminal) 11*tp* of the emitter 11 is exposed within the series of openings overlapping in their vertical direction. When this structure is viewed at the sectional end of FIG. 1, both the insulating films 25~29 and the electrodes 31, 13, 21~23 are individually provided to surround the emitter 11 while being separated in the radial direction with respect to the emitter tip 11*tp* to leave a space. Viewed in the radial direction, the opening inner peripheral edges 31*e*, 13*e*, and 21*e*~23*e* of the electrodes 31, 13, 21~23 are therefore respectively the nearest portions to the tip 11*tp*. Further, the sectional configuration resembles the shape near the crater of a conide (Fujiyama-shaped/conical) volcano, and the vicinity of the openings are all shaped to be upwardly mounded above the plain below.

In the field emission device of the present invention, differently from the conventional device shown in FIG. 4, the vertical position of the inner peripheral edge 13*e* of the extraction gate electrode 13 is at a higher position than vertical position of the tip 11*tp* of the emitter 11. In contrast to this, the vertical position of the opening inner peripheral edge 31*e* of the aberration suppressor electrode 31 added by the present invention for a new function is lower than the vertical position of the emitter tip 11*tp* which the opening inner peripheral edge 31*e* faces. In the case where the present invention is applied to a field emission device fabricated on predominantly the nano-order to submicron order, the diameter of the opening of the aberration suppressor electrode 31 exposing the emitter tip is defined on the submicron order or less, e.g., around 400 nm, but the vertical difference ds at this time should, as set out later, desirably be between 50 nm and 100 nm.

As already set out with reference to FIG. 4, the insulating films 26~29 within the stacked focusing electrode structure 20 desirably have their opening inner peripheral edges set back somewhat more in the radially outward direction than the peripheral edges 21*e*~23*e* of the electrodes 21~23 respectively formed on top of themselves. This is to prevent electron collision so that dielectric breakdown does not arise.

As regards the material and thickness of the electrodes 31, 13, 21~23, although arbitrary in principle, a film thickness that makes the device easy to fabricate should be chosen, and 100 nm niobium was utilized in the present inventors' prototype. The thickness of the insulating films was about 200 nm. It is of course possible to suitably select the thickness of each individual layer.

Here, by way of setting out examples of voltages applied to the electrodes present in preexisting devices (bias application examples), where the potential of the emitter 11 (0 V: generally the substrate potential) is defined as the reference potential, a positive voltage Vex is applied to the extraction gate electrode 13 to effectively extract electrons from the emitter 11. The voltage Vf1 applied to the focusing electrode 21 is made a higher voltage than Vex (Vf1>Vex). By this, the field strength of the emitter tip 11*tp* is prevented from declining when the electron beam is focused. While the voltage Vf2 applied to the second focusing electrode 22 and voltage Vf3 applied to the third focusing electrode 23 in order to focus the electron beam are made lower than the voltage Vf1 applied to the focusing electrode 21, they can be made the same voltage value (Vf1>Vf2=Vf3) or the third focusing electrode can be given a higher potential (Vf3≥Vf1). However, the present invention does not particularly stipulate regarding such matters. The key focus of the present invention is the addition of the aberration suppressor electrode 31 set out below and the new function thereof.

Specifically, in the present invention, the aberration suppressor electrode 31 is provided at a position where the vertical position of its opening inner peripheral edge 31*e* is a lower position than the vertical position of the emitter tip 11*tp*, desirably a position whereby its vertical difference ds becomes 50~100 nm when the diameter of the opening of the aberration suppressor electrode 31 is defined on the submicron order or less. A voltage Vsp of zero or negative as a relative potential with respect to the emitter potential is applied here. This aberration suppressing voltage Vsp is a voltage for controlling the equipotential lines near the emitter tip 11*tp* in a direction to be parallel, and when this is done, the potential distribution in the vicinity of the emitter tip 11*tp* can be reshape-controlled to a desirable shape, and by extension, spherical aberration of the electron beam emitted from the emitter tip can be effectively suppressed.

Figure 2:
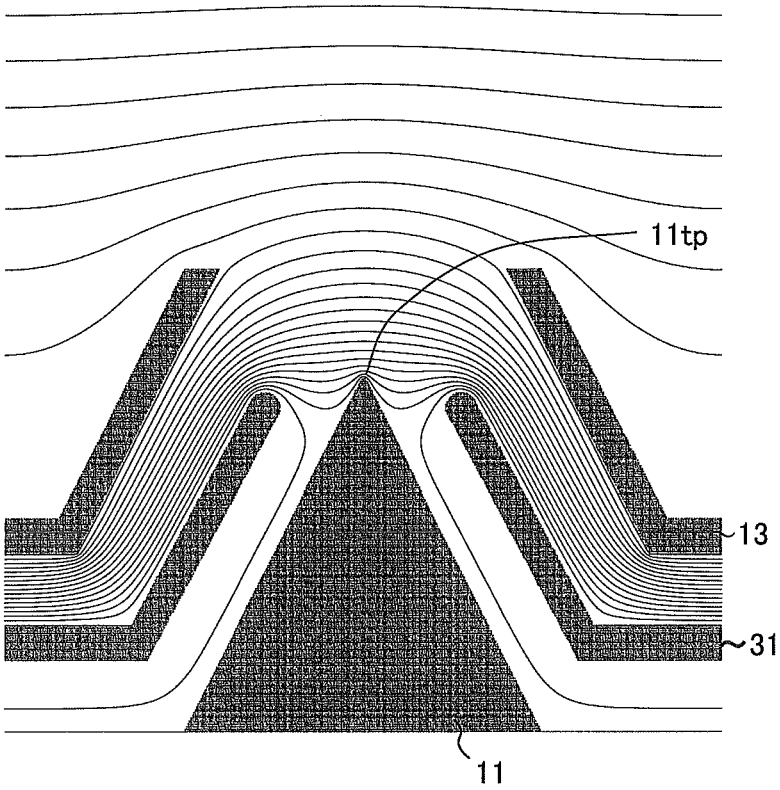
FIG. 2 is an explanatory diagram for explaining the form and potential distribution of equipotential lines near the emitter tip in the field emission device shown in FIG. 1.
Figure 6:
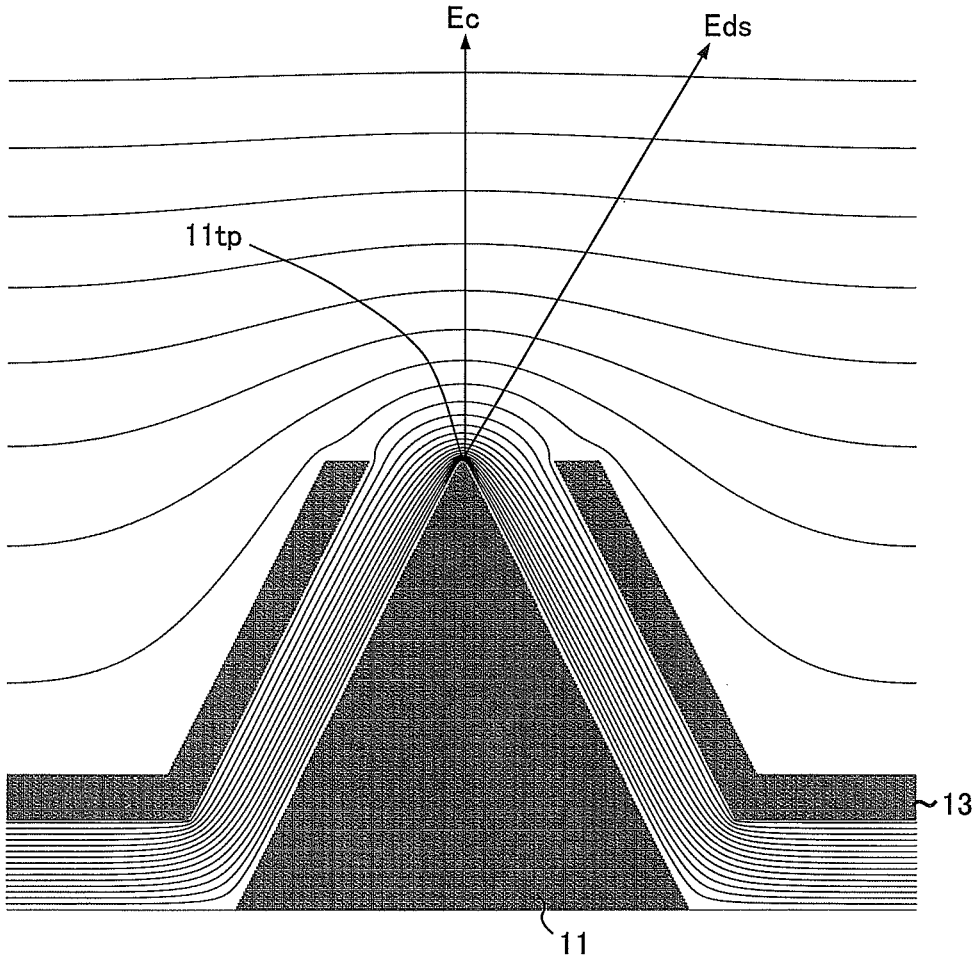
FIG. 6 is an explanatory diagram regarding ordinary potential distribution in the vicinity of an emitter tip and electron beam spherical aberration occurrence that may be caused thereby.

FIG. 2 is shows an example of simulation results in the case where the technical concept of the present invention is adopted. The opening diameter of the aberration suppressor electrode 31 was 400 nm, and where the potential of the emitter 11 was made the reference potential (0 V), voltage Vsp=−10 V was applied to the aberration suppressor electrode 31, and voltage Vex=100 V was applied to the extraction gate electrode 13, then, as apparent, the equipotential lines were desirably made quite parallel in comparison to the case of the conventional device of FIG. 6 in which no measure was taken regarding potential distribution near the emitter tip.

At a place apart from the center axis there is again a region very near the emitter surface where emission is accelerated in a direction away from the center axis, but it can be seen that many equipotential lines of a direction perpendicular to the center axis are formed thereafter to accelerate emission along the center axis. In the conventional device structure, such potential distribution was not controlled at all, while, in contrast, in accordance with the present invention, this can be positively controlled. Therefore, the aberration suppressor electrode can also be given the name of emission angle control electrode.

However, care may be required in the fabrication of an actual device. As the basic operation, field concentration occurs at the emitter tip 11*tp* owing to the presence of the extraction gate electrode 13, just above the emitter tip 11*tp*, applied with positive potential, and when the field strength of the emitter tip portion becomes a field strength of, for example, around $4\times10^7$ V/cm or greater, electron emission occurs. But in the field emission device fabricated in accordance with the present invention, owing to the presence of another electrode (aberration suppressor electrode 31) near the emitter tip 11*tp*, field concentration also occurs at this aberration suppressor electrode 31, and there is also a possibility that electron emission may occur from here. This is electron emission from a place where not properly required, and since it becomes a problem when the electron beam is focused, such electron emission from the aberration suppressor electrode 31 must be avoided.

In accordance with the technical concept of the present invention, the aberration suppressing voltage is applied to the newly provided aberration suppressor electrode 31 so as to make the equipotential lines (electric lines of force) near the emitter tip 11*tp* parallel, but also at this time, the electrode shape, particularly its height and applied voltage, must be defined with attention to the following items (1)~(3).

(1) The field strength particularly at the opening inner peripheral edge 31*e* of the aberration suppressor electrode 31 is to be made low enough not to produce field emission. For this, the work function and surface roughness condition of the aberration suppressor electrode 31 are also considered.

(2) The electric field on emitter tip is to be sufficiently high for electron emission.

(3) The electric strength voltage of the insulating film 25 between the emitter 11 and the aberration suppressor electrode 31 and the electric strength voltage of the insulating film 26 between the aberration suppressor electrode 31 and the extraction gate electrode 13 are not to be exceeded.

Figure 3:
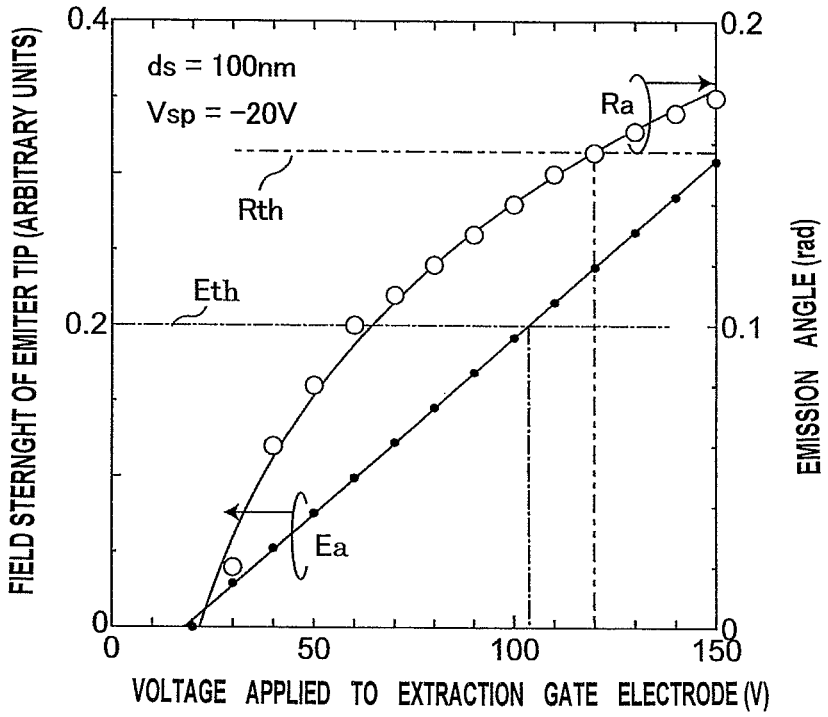
FIG. 3(A) is an explanatory diagram of the result of simulating the relationship between the field strength and emission angle as a function of the aberration suppressing voltage and extraction voltage when the aberration suppressing voltage Vsp applied to this aberration suppressor electrode was made −20 V in the case where the aberration suppressor electrode had a given height difference with respect to the emitter tip in an embodiment of the present invention.
FIG. 3(B) is an explanatory diagram of the result of simulating the relationship between the field strength and emission angle as a function of the aberration suppressing voltage and extraction voltage when the aberration suppressing voltage Vsp applied to the aberration suppressor electrode was made 0 V in the case where the aberration suppressor electrode had a given height difference with respect to the emitter tip in an embodiment of the present invention.
Figure 3:
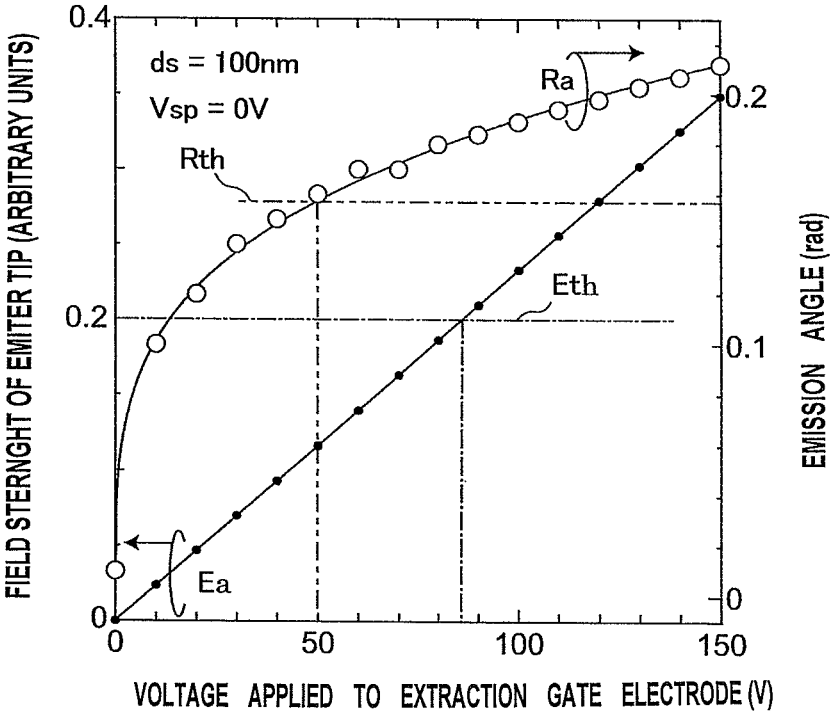
Figure 5:
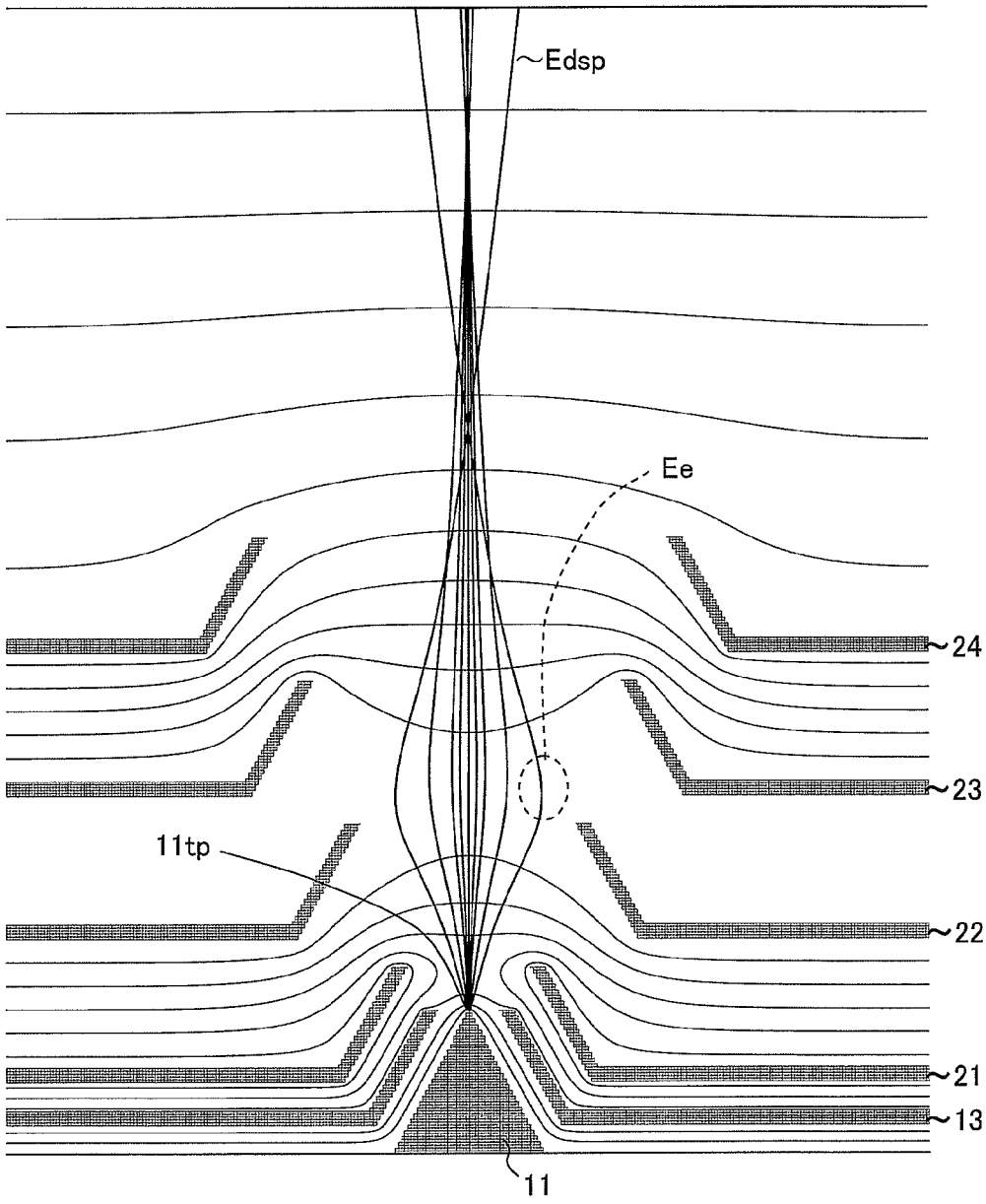
FIG. 5 is an explanatory diagram regarding electron beam spherical aberration that may occur in the field emission device shown in FIGS. 4(A) and (B).

In order to determine suitable conditions, field simulation and electron beam trajectory simulation were performed with consideration to such points. The results will be explained for two cases shown in FIGS. 3(A) and (B). In both, the opening diameter of the aberration suppressor electrode 31 was 400 nm. FIG. 3(A) shows the relationship between the field strength Ea at the emitter tip 11*tp*, the emission angle Ra and the voltage Vex applied to the extraction gate electrode 13 when the aberration suppressing voltage Vsp applied to this aberration suppressor electrode 31 was made −20 V in the case where the height of the aberration suppressor electrode 31 (effectively the height of the inner peripheral edge 13*e*) was defined 100 nm lower than the height of the emitter tip 11*tp* (vertical difference ds=100 nm).

In order for electron emission from the emitter tip 11*tp* to occur, the field strength Ea of the emitter tip 11*tp* must exceed the threshold electric field Eth, but in the case of FIG. 3(A), this condition could be read when the voltage Vex applied to the extraction gate electrode 13 was made approximately 105 V or greater. On the other hand, in order to obtain a good focused electron beam, the angle Ra of the emission had to be equal to or lower than the upper limit of threshold emission angle Rth (here defined as being about 0.157 rad or 10°) which was found beforehand undesirable to exceed). From these conditions, it could be read that the voltage Vex applied to the extraction gate electrode 13 should be approximately 120 V or less. Therefore, it can be seen that the voltage range of the voltage Vex applied to the extraction gate electrode 13 that satisfies both in this case is 105 V or greater to 120 V or less.

In contrast, looking at the case of FIG. 3(B), the fact that the height of the aberration suppressor electrode 31 is again defined as being 100 nm lower than the emitter tip 11*tp* is the same, but in the case where the voltage Vsp applied to the aberration suppressor electrode 31 is a relative potential of 0 V, i.e., is made the same as the emitter potential, it can be seen from the required conditions regarding the field strength Ea that Vex>85 V should be established. However, from the conditions for maintaining a good state of electron beam focusing, it turns out to be Vex<50 V, so it can be seen that in the end it becomes impossible to satisfy both conditions simultaneous under these conditions (ds=100 nm, Vsp=0 V).

Such simulation was performed in the range of a vertical difference ds of 0 to 200 nm between the height of the emitter tip 11*tp* and height of the lower aberration suppressor electrode 31 and in the range of applied voltage Vsp to −20 V in the negative direction, to obtain the necessary field concentration and further to determine the conditions enabling a good focused electron beam to be obtained. The results are shown in Table 1 below, and it is apparent from this Table that in accordance with the present invention it is possible at least at the worksite to determine the optimum size of the vertical difference ds and applied voltage value. In Table 1, the asterisks (*) are voltages that, based on past experience, are on the verge where dielectric breakdown or the like occurs. Further, the empty cells are cases where, as set out above, it is impossible to simultaneously satisfy the required field strength conditions and beam focusing conditions.

TABLE 1

| Aberration suppressing | Vertical difference between emitter tip and aberration suppressor electrode ds (nm) | | | |
|---|---|---|---|---|
| voltage Vsp (V) | 0 | 50 | 100 | 150 |
| 0 | 110-150 | | | |
| −2 | 110-150 | | | |
| −4 | 120-150 | | | |
| −6 | 120-150 | | | |
| −8 | 120-150 | 100 | | |
| −10 | 120-150 | 110 | | |
| −12 | * 130-150 | 110-120 | | |
| −14 | * 130-150 | 110-130 | 100 | |
| −16 | * 130-150 | 110-140 | 100 | |
| −18 | * 140-150 | 110-150 | 110 | |
| −20 | * 140-150 | * 120-150 | 110-120 | |

In this Table 1, the case of ds=200 nm is not shown in the first place because satisfactory results had not yet been obtained at ds=150 nm. However, in the desirable range of vertical difference ds of 50 nm or greater to 100 nm or less, it was possible to anticipate a considerably broad range of possible voltage application to the aberration suppressor electrode and also anticipate an effective aberration suppressing effect. If the opening diameter of the aberration suppressor electrode 31 is on the submicron order or less, the aforesaid results are not greatly affected by changes in its size. Further, although it can be seen in Table 1 that a range of applicable voltages existed even if the vertical difference was zero, in actuality the effective region in terms of aberration suppression existed in a range where the vertical position of the opening inner peripheral edge 31*e* of the aberration suppressor electrode 31 was made lower than the emitter tip 11*tp*, and the range of 50 nm or greater to 100 nm or less was especially desirable.

Moreover, as a practical consideration, in order to suppress undesirable field emission from the aberration suppressor electrode 31 itself, it is desirable to use a material of high work function, and as shown enlarged, surrounded by a phantom line circle in FIG. 1, it is advisable, notwithstanding structural measures taken, to process the surface of the opening inner peripheral edge 31*e* to a smooth shape having no angle, e.g., to a sectionally rounded shape, so as to avoid a sharp angle at the joining edges between the electrode surface of the aberration suppressor electrode 31 and the face of the peripheral edge 31*e* orthogonal thereto.

Where simply viewed only in sectional structure, then, as a structure which provides the electrode at a lower position relative to the emitter tip, there is, for example, the sectional structure of Document 6 indicated below, particularly in FIG. 7.

Document 6: Japanese Patent No. 3547531

However, as clearly seen, the electrode called a suppressor electrode set out in the Document 6 concerned is, as in the explanation regarding FIG. 7, one provided solely to suppress thermionic emission from the emitter, and not one even remotely capable of controlling potential distribution at the emitter tip as in the present invention. It cannot constitute the aberration suppressor electrode 31 termed by the present invention. It is not one processed on the nano-order as assumed for the field emission device that is the subject of the present invention, and the opening diameter of the suppressor electrode is all of 0.4 mm. The vertical difference relative to the emitter tip is as great as 0.25 mm. With this dimensional relationship, parallel control of the equipotential lines near the emitter tip is hardly possible, and no trace whatsoever of a technical concept like that of the present invention can be found in Document 6 in the first place.

In FIG. 1, the control unit system is shown concomitantly, from a more practical consideration. In the case where the field emission device of the present invention is used in an electron microscope or electron beam exposure apparatus, stabilization of the electron beam is required. For such purpose, there is, for example, a simple method of connecting a field effect transistor to the emitter, as disclosed in Document 7 indicated below.

Document 7: Japanese Patent No. 2835434

However, in the final analysis, the principle of this is, for stabilizing current, to hold the current discharged from the emitter constant by varying the potential of the emitter. But in the case where the electron beam is to be focused, if the potential of the emitter fluctuates, that means that the acceleration energy of the electron beam fluctuates, with the result that chromatic aberration is caused, which is unsuitable.

In contrast, the device of the present invention enables highly rational control. Actually, as shown concomitantly in FIG. 1, an applied voltage control circuit 51 incorporating a microcomputer or the like to conduct software control operates to apply suitable voltages satisfying the various conditions set out above to the aberration suppressor electrode 31, extraction gate electrode 13 and focusing electrodes 21~23 through an aberration suppressing voltage application circuit 52, extraction voltage application circuit 53, and focusing voltage application circuits 54~56, respectively, while using an anode current measurement circuit 61 to perform step-by-step measurement of the current at the anode electrode 41 which finally captures the electrons, so that when fluctuation occurs in the anode current for some reason, it is easily possible to feedback-control the extraction voltage to maintain the current constant.

In addition, when the extraction voltage Vex is varied to keep the anode current constant, ordinarily the field distribution around the emitter changes to also change the focusing conditions, but in the present invention the aberration suppressor electrode 31 is provided, so in order to maintain a better focused state under the command of the applied voltage control circuit 51, feedback control is made possible also to make variable the aberration suppressing voltage Vsp applied to the aberration suppressor electrode 31 through the aberration suppressing voltage application circuit 52. Actually, optimum conditions with respect to various extraction voltages are recorded beforehand in the form of a lookup table in an unshown memory or the like provided in the applied voltage control circuit 51, and while referring to this, control is possible so as to apply aberration suppression voltage in accordance with the extraction voltage required from time to time.

Although a preferred embodiment of the present invention was explained in the foregoing, desired modifications can be freely made insofar as they conform to the gist and constitution of the present invention.

The invention claimed is:

1. A field emission device comprising an emitter on a substrate constituting an electron emission terminal having a sharp tip, and an extraction gate electrode having an opening that exposes the emitter tip and causes emission of electrons from the emitter by applying an extraction voltage;

the field emission device further comprising an aberration suppressor electrode having an opening that exposes the emitter tip and whose opening inner peripheral edge is provided at a position nearer the emitter tip than the opening inner peripheral edge of the extraction gate electrode;

wherein while the inner peripheral edge of the opening of the extraction gate electrode being higher than a vertical position of the emitter tip, a vertical position of the inner peripheral edge of the opening of the aberration suppressor electrode is lower than a vertical position of the emitter tip;

an aberration suppressing voltage application circuit is connected to the aberration suppressor electrode; and the aberration suppressing voltage application circuit applies to the aberration suppressor electrode an aberration suppressing voltage in a voltage range lower than the emitter potential to control equipotential lines in the vicinity of the emitter tip to be parallel.

2. A field emission device according to claim 1, wherein:

a diameter of the opening of the aberration suppressor electrode that exposes the emitter tip is submicron order or less and a vertical difference between a vertical position of the aberration suppressor electrode and a vertical position of the emitter tip is 50 nm or greater to 100 nm or less.

* * * * *